US005404689A

United States Patent [19]

DiNarda

[11] Patent Number: 5,404,689

[45] Date of Patent: Apr. 11, 1995

[54] ANCHOR BOLT SLEEVE

[76] Inventor: Dennis R. DiNarda, 914 Miles Ave., NW., Canton, Ohio 44708

[21] Appl. No.: 11,720

[22] Filed: Feb. 1, 1993

[51] Int. Cl.[6] ..... E04B 1/38; E04C 5/00; F16B 39/02

[52] U.S. Cl. ..... 52/699; 52/704; 411/82

[58] Field of Search ..... 411/15, 19, 34, 907, 411/82; 52/699, 704, 707

[56] References Cited

U.S. PATENT DOCUMENTS

| | | | |
|---|---|---|---|
| 3,500,607 | 3/1970 | Wilson | 52/699 |
| 3,867,804 | 2/1975 | Wilson | 52/699 |
| 4,117,643 | 10/1978 | Lamothe | 52/704 X |
| 4,989,389 | 2/1991 | Maechtle et al. | 52/707 X |

*Primary Examiner*—Neill R. Wilson
*Attorney, Agent, or Firm*—Michael Sand Co.

[57] ABSTRACT

An anchor bolt sleeve for sliding over an anchor bolt to create a void therearound when concrete is being poured to secure the anchor bolt in the concrete. The sleeve has a one piece hollow body with a generally cylindrical sidewall joined at each end by a respective endwall. An annular boss extends outwardly from each endwall and has a reduced diameter from that of the body sidewall. A second boss extends outwardly from the center of the first boss and has a smaller diameter than the diameter of the first boss. An inner diameter of each of the bosses is sized to correspond to a predetermined outer diameter of a usual anchor bolt. An alternative embodiment provides a hollow sleeve body having rigid end portions joined by an intermediate section with a collapsible corrugated sidewall. The collapsible sidewall defined by a plurality of corrugations which extend horizontally around the section, enables the axial length of the sleeve to be easily adjusted in the field after being mounted on an anchor bolt.

13 Claims, 5 Drawing Sheets

ANCHOR BOLT SLEEVE

BACKGROUND OF THE INVENTION

1. Technical Field

The invention relates generally to an improved anchor bolt sleeve. More particularly, the invention relates to a sleeve which is fitted over anchor bolts that are secured within concrete to secure a structure thereto after the concrete is poured. Specifically, the invention relates to apparatus which is fitted over the anchor bolt to prevent the concrete from contacting the entire bolt length such that the bolt may be flexed or bent after the concrete is hardened.

2. Background Information

It is customary in construction to set anchors in concrete while the concrete is poured such that later, after the concrete has hardened, the bolt will extend upwardly from the concrete surface. The size of the bolt is dependent on the machine or structure that will ultimately be mounted thereto, and as such, a wide range of bolt sizes are available. However, the bolts are seldom perfectly placed in the concrete, and often the holes in the machine mounting brackets do not align perfectly with the bolts, thereby making the mounting of the machines more difficult.

Heretofore, the bolts have been removed from the concrete, with the concrete in that area then being reformed with the bolts correctly positioned. This process is costly, but more importantly, the concrete is weakened, as the area around the bolt is not homogenous with the remainder of the concrete slab. To overcome these problems, anchor bolt sleeves have been created which slide over the bolt such that when the concrete is poured, the sleeve creates a void around the bolt where the concrete cannot flow. This area may then be utilized to flex the bolt, or even bend the bolt to assure that the anchor bolt is in alignment with the machine mounting brackets. The bolts are easier to flex or bend, as the free length of the bolt remaining unsecured by the concrete, is increased via the void created by the sleeve.

However, the sleeve often slides down the anchor and thus becomes useless after the concrete slab hardens. Moreover, a significant number of sizes must be stocked to correspond to the variety of bolt sizes available on the market.

Therefore, a need exists for an anchor bolt sleeve which will remain correctly positioned on the anchor bolt on which it is installed. Moreover, a need exists for a sleeve which may be utilized for a variety of bolt sizes such that a small number of parts may be stocked, and later carried to the job site thereby significantly reducing costs.

SUMMARY OF THE INVENTION

Objectives of the invention include providing an improved anchor bolt sleeve that remains positioned on the anchor bolt at the height at which the sleeve is installed.

A further objective includes providing such an anchor bolt sleeve that is an integrally molded one piece unit that can be easily and quickly installed.

Another objective is to provide such a sleeve which may be easily altered to slide over a variety of diameter anchor bolts.

Yet another objective is to provide such an anchor bolt sleeve which may be expanded to assume a variety of lengths, which length may be altered on the job site depending on the application.

A still further objective is to provide such an anchor bolt sleeve which is of simple construction, which achieves the stated objectives in a simple, effective and inexpensive manner, and which solves problems and satisfies needs existing in the art.

These and other objectives and advantages of the invention are obtained by the improved anchor bolt sleeve for creating a void in concrete around an anchor bolt positioned within the concrete to provide a void around the anchor bolt, such that the anchor bolt may be flexed or bent while installed in a concrete slab to align the bolt with a machine mounting bracket, the general nature of which may be stated as including a hollow body having a first and second end; said first and second ends thereof having at least two reduced diameter bosses in a step arrangement extending outwardly from said first and second ends; and each of said reduced diameter portions being complimentarily sized to frictionally engage one of the variety of anchor bolts around which the sleeve is adapted to fit.

BRIEF DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
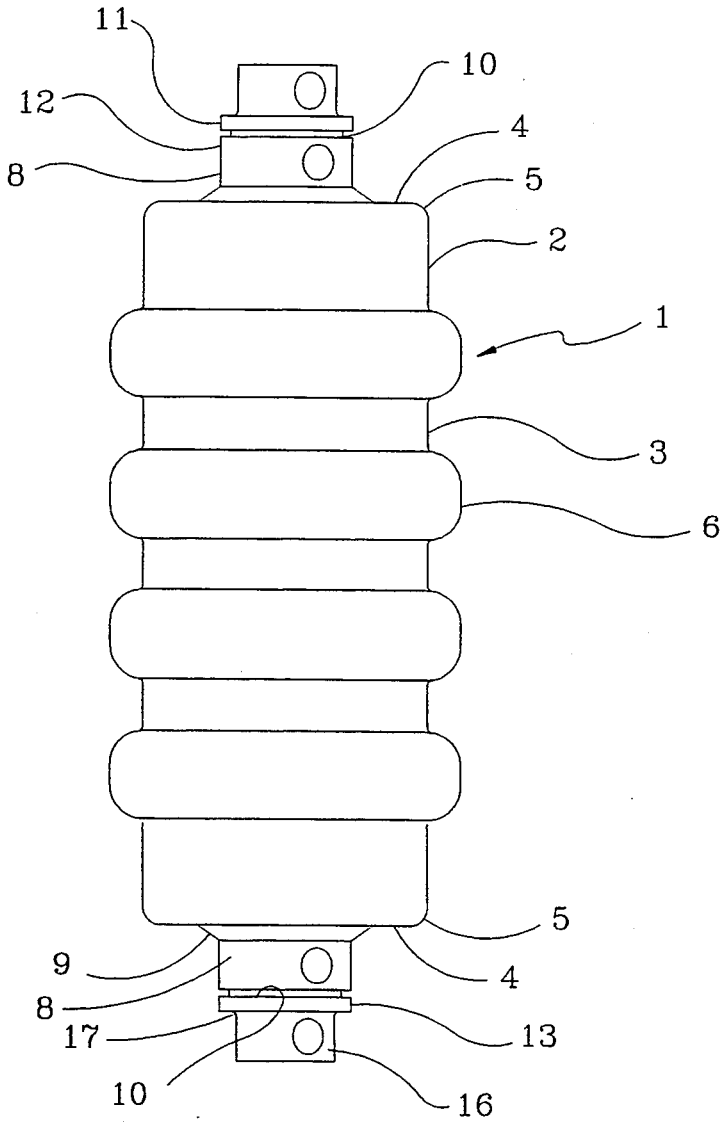
FIG. 1 is a side elevational view of the anchor bolt sleeve of the first embodiment of the present invention.
Figure 2:
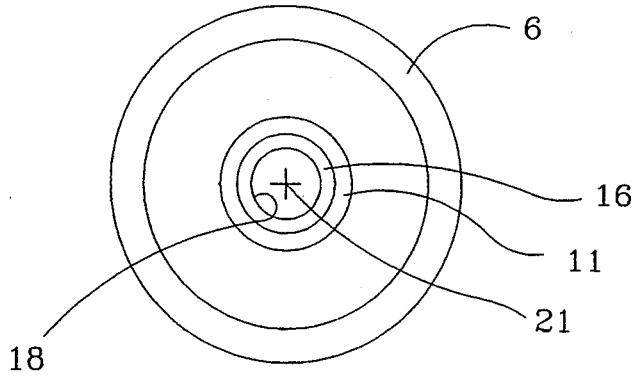
FIG. 2 is a top plan view of the anchor bolt sleeve shown in FIG. 1.

The improved anchor bolt sleeve of the present invention is indicated generally at 1, and is shown particularly in FIGS. 1–2. Sleeve 1 is preferably formed as a one piece integrally molded plastic member, preferably molded of high impact polypropylene or other suitable molded plastic. Sleeve 1 includes a body 2 having a generally cylindrical shape. Body 2 has a cylindrical sidewall 3 terminating at endwalls 4 with convex fillets 5 joining endwalls 4 and sidewall 3. A number of bulbous portions 6 extend circumferentially around sidewall 3 and are preferably equally spaced in the axial direction of body 2. Bulbous portions 6 are annular in cross section, and have an outer diameter somewhat larger than that of sidewall 3.

Figure 4:
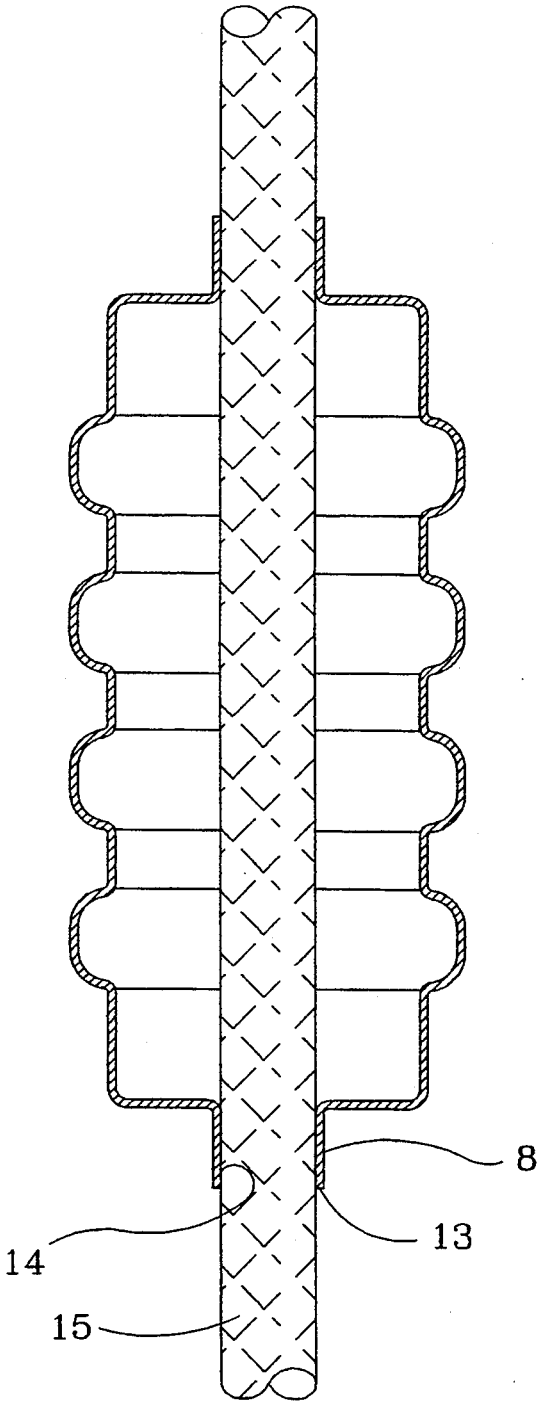
FIG. 4 is a side elevational view, in section, of the anchor bolt sleeve shown in FIG. 1 installed on another anchor bolt having a larger diameter than the bolt shown in FIG. 3.

A first annular boss 8 is formed integrally with each endwall 4 and extends outwardly from a center portion of each endwall and joins the endwalls at concave fillets 9. A circumferential groove 10 extends around the top of boss 8, having an annular rib 11 of boss 8 above the groove, and a portion 12 below the groove. Groove 10 thus provides an area of reduced material thickness, defined by rib 11 and portion 12. Each boss 8 terminates at a free end 13 and has an aperture 14 therethrough which is complementary sized to an anchor bolt 15 of a predetermined size (FIG. 4).

Figure 3:
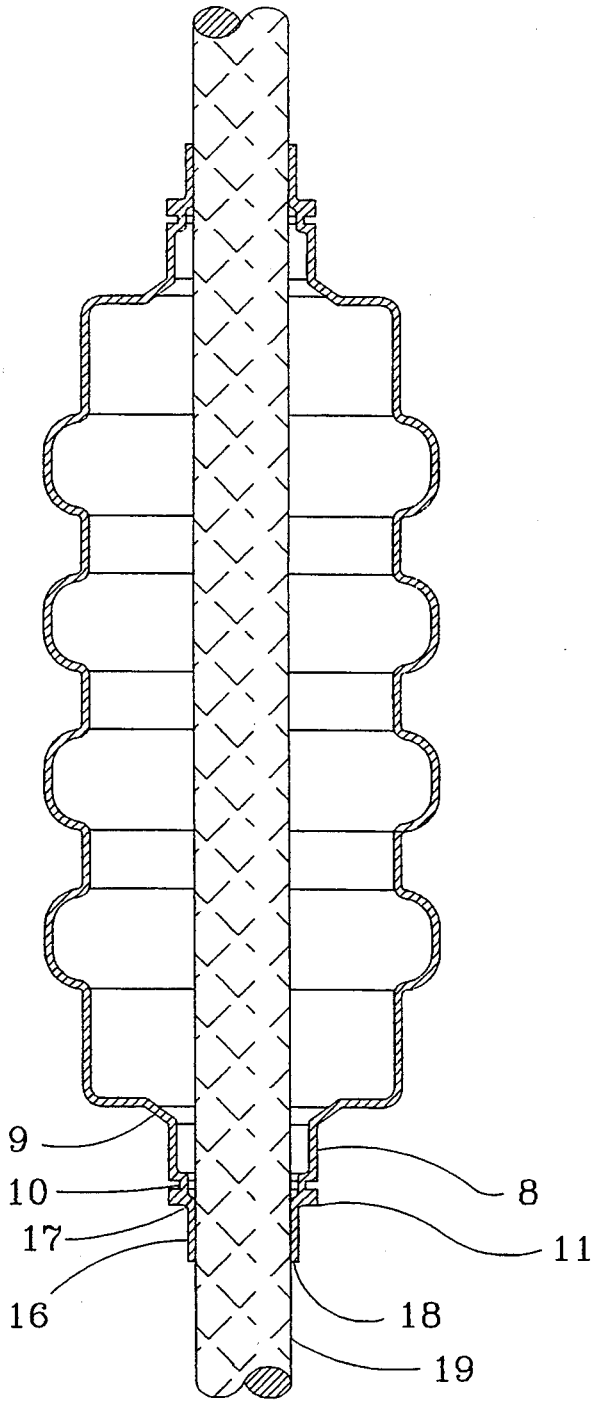
FIG. 3 is a side elevational view, in section, of the anchor bolt sleeve shown in FIG. 1 installed on an anchor bolt.

In accordance with one of the main features of the present invention, a boss 16 extends outwardly from free end 13 of boss 8 and is coaxial and is formed integrally therewith. Boss 16 has a smaller diameter than boss 8, and joins boss 8 at an annular concave fillet 17. Thus bosses 8 and 16 provide a step arrangement, the purpose for which will become more apparent hereinbelow. Boss 16 has an aperture 18 therethrough which is complementarily sized to that of a second anchor bolt 19 of a predetermined size (FIG. 3). Body 2 is preferably cylindrical and has an axial centerline 21. Inasmuch as this longitudinal axis extends through the center of each endwall 4, bosses 8 and 16 also are centered on the longitudinal axis of body 2. At least one detent 20 is provided in each of bosses 8 and 16 to frictionally engage the anchor bolt, and provide further assurance that the sleeve will remain properly positioned on the vertical length of the bolt.

Figure 5:
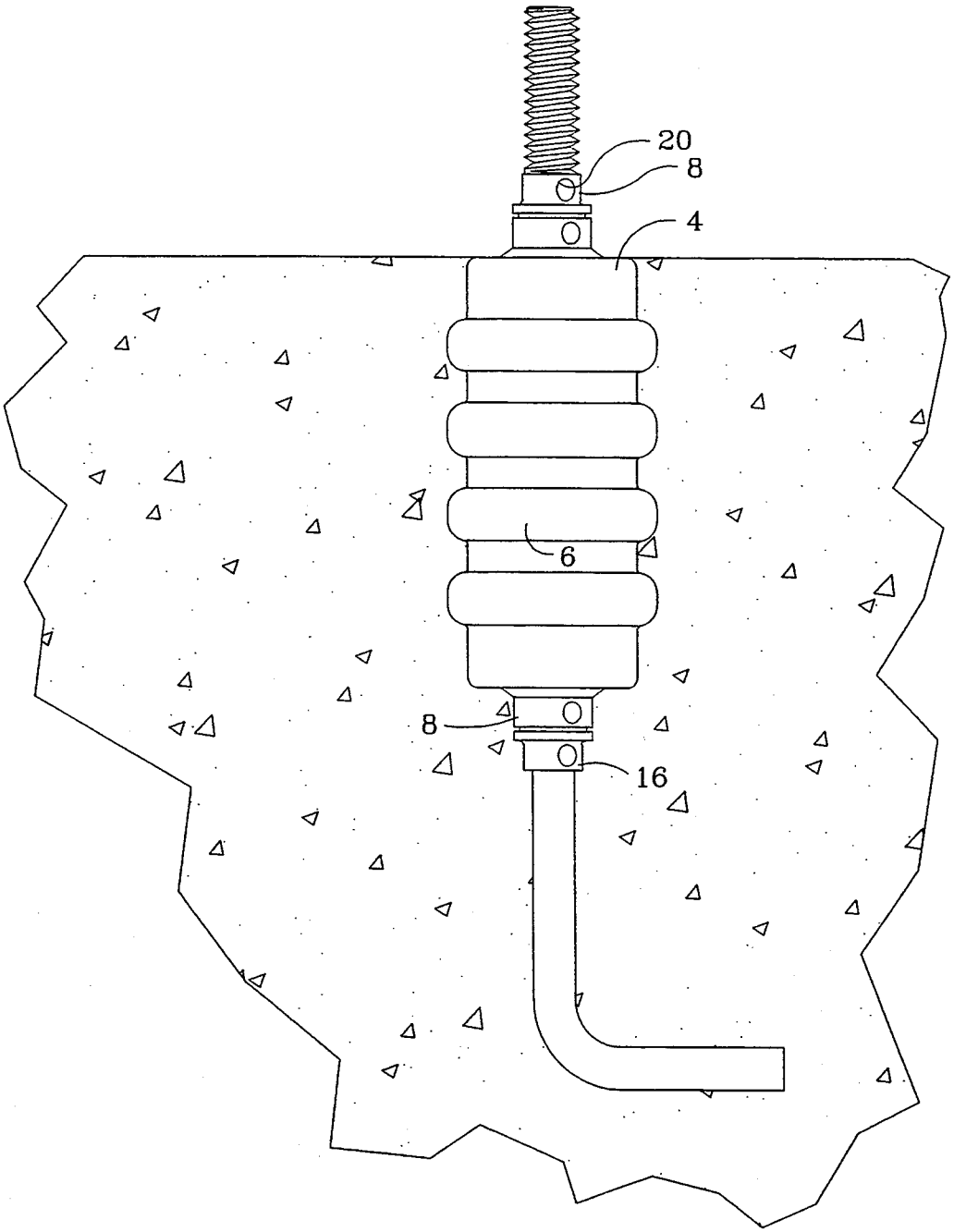
FIG. 5 is a side elevational view of the anchor bolt sleeve shown in FIG. 1, installed on an anchor bolt, with the anchor bolt and sleeve shown in association with a concrete slab.

Having now described the anchor bolt sleeve 1 in detail, the installation of sleeve 1 (FIGS. 1 and 2) onto an anchor bolt is described. First, a sleeve having a boss opening 14 sized to the diameter of the anchor bolt must be chosen. If the bolt's diameter corresponds to the diameter of the opening of boss 16 which is most distant axially from the body 2, then the sleeve is placed over the anchor bolt such that the bosses 16 frictionally engage the anchor bolt as shown particularly in FIG. 3. The sleeve is placed around the bolt at a height where a void in the concrete will be created when the concrete is poured around the bolt. Referring to FIG. 5, it is noted that when the concrete is poured around the sleeve, and hardens, it creates an inner cavity that is complementarily shaped to sleeve 1. Bulbous portions 6 help to secure the sleeve's position in the poured concrete as they provide more surface area to contact the concrete, as well as provide horizontal surfaces which may be supported in the concrete.

Once installed, the top exposed endwall 4 is cut away and removed from the bolt exposing the interior of sleeve 1 such that the bolt may be bent or flexed to align with the mounting bracket of the machine (not shown) to be mounted thereon within the interior of the sleeve. The remainder of the sleeve is then filled with concrete by pouring it into the open top of sleeve 1, to secure the bolt in position after the bolt is bent into correct alignment.

Alternatively, if sleeve 1 is to be installed on a bolt having a larger diameter, for example corresponding to second boss 8, the installer must cut away first boss 16. Specifically, the installer will place a knife in groove 10, and remove the bosses 16 with ribs 11 and portion 12 acting to guide the knife along groove 10. Once the installer severs boss 16 at groove 10, the free end 13 of boss 8 is clear with no material extending past the interior of the boss such that the anchor bolt may be placed therethrough free of obstruction. This unobstructed boss is created because the rib 11 and portion 12 of boss 8 are of equal diameter. If the installer cut boss 16 off at the free end 13 of boss 8, material would continue into boss 8. This problem is avoided by the present invention. The ultimate product of this operation is shown in FIG. 4 installed on an anchor bolt 15.

Figure 6:
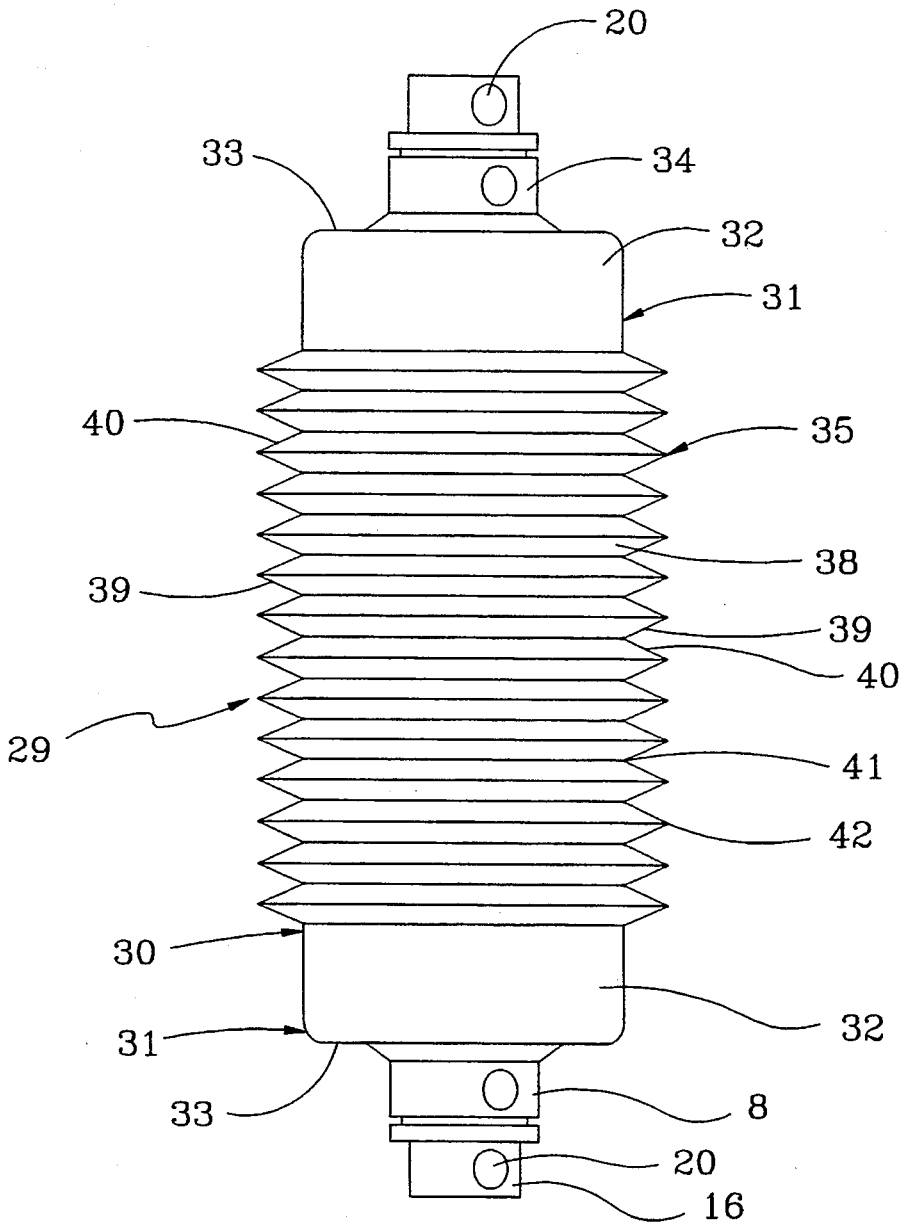
FIG. 6 is a side elevational view of a second embodiment of the present invention.

A second embodiment of the anchor bolt sleeve is indicated generally at 29, and is shown in FIG. 6. Sleeve 29 has an annular hollow body 30 which terminates in rigid end sections 31. Each end section 31 has a cylindrical sidewall 32 and an endwall 33. Moreover, each of the endwalls has at least one boss, and preferably two bosses extending outwardly therefrom in the same manner described above for sleeve 1.

In accordance with one of the main features of this second embodiment, an intermediate section indicated generally at 35, is formed with a plurality of annular corrugations 38 extending horizontally around section 35. Intermediate section 35 preferably is formed integrally with sidewalls 32 of rigid end sections 31. Each corrugation 38 is defined by a pair of inwardly extending sidewalls 39 and 40 forming a V-shaped configuration terminating in a lower valley or base 41 and an outer ridge or peak 42. As the rigid end sections 31 and intermediate section 35 share a common longitudinal axis, they define body 30. The thickness of the material in intermediate Section 35, which preferably is similar to that of sleeve 1, should provide the desired flexibility to allow the intermediate section to be collapsed, yet rigid enough to prevent the anchor bolt sleeve from loosing its shape when the concrete is poured therearound. The non-collapsible rigid sidewalls 32 provide stiffness in the axial direction, that the intermediate section 38 does not provide due to corrugations 38.

The operation of the second embodiment sleeve 29 is similar to that of sleeve 1. However, if the installer believes that more or less of the bolt should be provided with a void therearound, or if the bolt is abnormally long or short, then the second embodiment will be utilized. The installer can pull axially on sleeve 29 to expand the corrugations, or alternatively, the installer can axially compress the sleeve to shorten the sleeve length as a particular application would require. In this manner, the sleeve 29 may be utilized with a variety of bolt lengths. This feature in combination with the stepped bosses described in the first embodiment, provide a sleeve that may be utilized on a variety of anchor bolt sizes.

As should be apparent to one skilled in the art, the number of bosses provided in a step fashion at the ends of the sleeve described hereinabove, may vary depending on the number of size anchor bolts that will utilize the anchor bolt sleeve. Similarly, the number of bulbous portions 6 which are spaced around the sidewall 3 may vary without departing from the spirit of the present invention. Moreover, the number of corrugations 38 utilized in the second embodiment also may be altered without departing from the spirit of the present invention. Lastly, the invention has been described as cylindrical for convenience. However, as should be apparent to one skilled in the art, the invention could take a variety of shapes, as long as the bosses continue to frictionally engage the anchor bolt.

Accordingly, the improved anchor bolt sleeve is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principle of the invention, the manner in which the improved anchor bolt sleeve is constructed and used, the characteristics of the construction, and the advantageous, new and useful results obtained; the new and useful structures, devices, elements, arrangements, parts and combinations, are set forth in the appended claims.

I claim:

1. An anchor bolt sleeve adapted to create a void around a selected one of a variety of sizes of anchor bolts when the anchor bolt is installed in a concrete slab, said sleeve comprising:

a hollow body having a body sidewall and a first and a second end wall extending substantially normal to the body sidewall;

each of said first and second ends thereof having at least two reduced cross-sectional area bosses in a step arrangement extending outwardly from said first and second ends; and each of said reduced cross-sectional area bosses being complementarily sized to frictionally engage a selected one of a variety of sizes of anchor bolts around which the sleeve is adapted to fit.

2. An anchor bolt sleeve as defined in claim 1 wherein the body is cylindrical and has an axial centerline therethrough.

3. An anchor bolt sleeve as defined in claim 2 wherein the first and second reduced diameter bosses are cylindrical having an axial centerline therethrough; and in which the axial centerline of said reduced diameter bosses is in alignment with the axial centerline of said body.

4. An anchor bolt sleeve adapted to slidably accept an anchor bolt therethrough, the sleeve comprising:

an integral one-piece hollow body having a first section, an intermediate section, and a second section;

said first and second sections being similar with each having a sidewall with first and second ends and an endwall, with said first ends being connected to the intermediate section, and said second ends being connected to a respective endwall;

a hollow boss formed on each of said endwalls;

said intermediate section having a collapsible sidewall defined by corrugations extending substantially horizontally around the sections comprising alternating ridges and valleys; and said first and second section sidewalls being free from corrugations to provide non-collapsible rigid sidewalls stiffer in the axial direction than the sidewall of the intermediate section.

5. An anchor bolt sleeve as defined in claim 4 wherein the first, second, and intermediate portion include a cylindrical sidewall and have an axial centerline therethrough.

6. An anchor bolt sleeve as defined in claim 5 further comprising at least two bosses in a step arrangement extending outwardly from the first and second endwalls; in which each of said bosses is formed with a different size internal diameter opening; in which each endwall is substantially normal to the cylindrical sidewall of the first and second portion and in which each of said openings is complementarily sized to frictionally engage a respective one of the variety of anchor bolts on which the sleeve may be slidably mounted.

7. An anchor bolt sleeve as defined in claim 6 wherein the bosses are cylindrical having a coaxial centerline therethrough, and in which the coaxial centerline of said bosses is in alignment with the axial centerline of said body.

8. An anchor bolt sleeve as defined in claim 7 further comprising an annular region of reduced material thickness formed between the bosses to provide an area for cutting an unneeded boss off of the sleeve.

9. An anchor bolt sleeve adapted to create a void around a selected one of a variety of sizes of anchor bolts when the anchor bolt is installed in a concrete slab, said sleeve comprising:

a hollow body which is cylindrical and has an axial centerline therethrough having a first and second end extending substantially normal to the body sidewall;

said first and second ends thereof having at least two reduced cross-sectional area bosses in a step arrangement extending outwardly from said first and second ends wherein the first and second reduced diameter bosses are cylindrical having an axial centerline therethrough; and in which the axial centerline of said reduced diameter boss is in alignment with the axial centerline of said body;

each of said reduced cross-sectional area bosses being complementarily sized to frictionally engage a selected one of a variety of sizes of anchor bolts around which the sleeve is adapted to fit; and an annular region of reduced material thickness to provide an area for cutting an unneeded boss off of the sleeve.

10. An anchor bolt sleeve as defined in claim 9 where the annular region of reduced material thickness is spaced longitudinally within a top portion of each successively stepped boss, except a smallest diameter boss, such that when an unneeded boss is removed, no plastic remains to interfere with an anchor bolt sliding therethrough.

11. An anchor bolt sleeve adapted to slidably accept an anchor bolt therethrough, the sleeve comprising:

an integral one-piece hollow body having a first section, an intermediate section, and a second section and wherein the first, second, and intermediate portion are cylindrical and have an axial centerline therethrough;

said first and second sections being similar with each having a sidewall with first and second ends and an endwall, with said first ends being connected to the intermediate section, and said second ends being connected to a respective endwall;

a hollow boss formed on each of said endwalls;

said intermediate section having a collapsible sidewall defined by corrugations extending substantially horizontally around the sections comprising alternating ridges and valleys;

said first and second section sidewalls being free from corrugations to provide non-collapsible rigid sidewalls stiffer in the axial direction than the sidewall of the intermediate section; and at least two cylindrical bosses having a coaxial centerline therethrough, and which coaxial centerline is in alignment with the axial centerline of said body extending outwardly from the first and second endwalls; and in which each of said bosses is formed with a different size internal diameter opening; and in which each of said openings is complementarily sized to frictionally engage a respective one of the variety of anchor bolts on which the sleeve may be slidably mounted; and an annular region of reduced material thickness formed between the bosses to provide an area for cutting an unneeded boss off of the sleeve.

12. An anchor bolt sleeve adapted to create a void around a selected one of a variety of sizes of anchor bolts when the anchor bolt is installed in a concrete slab, said sleeve comprising:

a hollow body having and a first and second end;

said first and second ends thereof having at least two reduced cross-sectional area bosses in a step arrangement extending outwardly from said first and second ends;

each of said reduced cross-sectional area bosses being complementarily sized to frictionally engage a selected one of a variety of sizes of anchor bolts around which the sleeve is adapted to fit; and an annular region of reduced material thickness to provide an area for cutting an unneeded boss off of the sleeve.

13. An anchor bolt sleeve adapted to slidably accept an anchor bolt therethrough, the sleeve comprising:

an integral one-piece hollow body having a first section, an intermediate section, and a second section;

said first and second sections being similar with each having a sidewall with first and second ends and an endwall, with said first ends being connected to the intermediate section, and said second ends being connected to a respective endwall;

a hollow boss formed on each of said endwalls;

said intermediate section having a collapsible sidewall defined by corrugations extending substantially horizontally around the sections comprising alternating ridges and valleys;

said first and second section sidewalls being free from corrugations to provide non-collapsible rigid sidewalls stiffer in the axial direction than the sidewall of the intermediate section; and an annular region of reduced material thickness to provide an area for cutting an unneeded boss off of the sleeve.

* * * * *